US006089481A

United States Patent [19]

Young

[11] Patent Number: 6,089,481

[45] Date of Patent: Jul. 18, 2000

[54] APPARATUS FOR RELIEVING THE LOAD ON ADJUSTING RODS OF A CRUSHER

[75] Inventor: Gregory A. Young, Cedar Rapids, Iowa

[73] Assignee: Cedarapids, Inc., Cedar Rapids, Iowa

[21] Appl. No.: 09/272,992

[22] Filed: Mar. 20, 1999

[51] Int. Cl.[7] ..... B02C 13/282

[52] U.S. Cl. ..... 241/189.1; 241/286

[58] Field of Search ..... 241/286–7, 290, 241/189.1, 285.2

[56] References Cited

U.S. PATENT DOCUMENTS

| | | | |
|---|---|---|---|
| 2,877,956 | 3/1959 | Sackett | 241/189.1 |
| 2,962,233 | 11/1960 | Chryst et al. | 241/286 |
| 4,017,035 | 4/1977 | Stuttman | 241/189.1 |
| 5,921,483 | 7/1999 | Folling et al. | 241/286 |

*Primary Examiner*—Mark Rosenbaum
*Attorney, Agent, or Firm*—Marshall, O'Toole, Gerstein, Murray & Borun

[57] ABSTRACT

An apparatus for selectively relieving the load on the adjusting rods of a horizontal shaft impact crusher is disclosed. The apparatus includes a linear actuator mounted to the exterior of the crusher frame. It also includes a bridge having a bearing section disposed adjacent the linear actuator. The bridge is secured to the adjusting rods such that, energizing the linear actuator applies a force to the bearing section of the bridge to thereby at least partially relieve the load on the adjusting rods. The bridge is sized such that, when the linear actuator is in the released state, the bridge does not add to the height of the crusher.

22 Claims, 7 Drawing Sheets

50
60
70
72
74
76
78
80
84
88
90
92
96

APPARATUS FOR RELIEVING THE LOAD ON ADJUSTING RODS OF A CRUSHER

FIELD OF THE INVENTION

The invention relates generally to horizontal shaft impact crushers, and, more particularly, to an apparatus for selectively relieving the load on the adjusting rods supporting a breaker plate of such a crusher to facilitate adjustment of the rods.

BACKGROUND OF THE INVENTION

Horizontal shaft impact crushers are commonly employed to pulverize many different types of materials including, by way of examples, not limitations, asphalt, concrete, and rock. Such crushers typically include a frame defining a cavity. A rotating impeller driven by an external drive mechanism is disposed within the cavity. The frame includes an opening through which the material to be crushed is inserted into the cavity. One or more breaker plates are generally disposed within the cavity. The rotating impeller repeatedly throws the material to be crushed against the breaker plate(s) thereby breaking the material into small particles.

Each of the breaker plates is generally pivotally mounted within the cavity such that its angular position may be changed to suit the type of material being crushed. To this end, each breaker plate is typically supported within the cavity by a number of adjusting rods (typically two). The adjusting rods extend out of the frame. By adjusting the position of the rods (e.g., pulling the rods further out of the cavity or pushing them further into the cavity), an operator can adjust the position of the associated breaker plate.

Breaker plates are generally relatively heavy. Therefore, it is difficult to adjust the position of the adjusting rods without reducing or relieving the weight of the breaker plate from the adjusting rods. To this end, some prior art devices employ one or more hydraulic cylinders which act as jacks to support the breaker plate weight during the adjustment procedure. Such cylinders are traditionally mounted to a bridge which is, in turn, mounted to the adjusting rods. Unfortunately, these prior art bridges add to the overall height of the crusher and leave the cylinders exposed to damage, especially during transport of the crusher.

The present invention allows the weight of the breaker plates to be supported during adjustment of the adjusting rods without materially adding to the overall height of the crusher.

SUMMARY OF THE INVENTION

In accordance with an aspect of the invention, an apparatus is provided for selectively relieving the load on the adjusting rods of a horizontal shaft impact crusher. The apparatus includes a first linear actuator mounted to a frame of the crusher outside of a cavity of the crusher. The first linear actuator has a first position and a second position. The bridge has a first bearing section disposed adjacent the first linear actuator. The bridge is secured to each of the adjusting rods such that, as the first linear actuator moves from the first position to the second position, the first linear actuator applies a force to the first bearing section to thereby at least partially relieve the load on the adjusting rods. The bridge is sized such that, when the first linear actuator is in the first position, the bridge does not add to the height of the crusher.

In accordance with another aspect of the invention, a bridge is provided for use with a horizontal shaft impact crusher having a frame defining a cavity, a breaker plate, a pair of adjusting rods supporting the breaker plate within the cavity and extending out of the cavity, and a pair of linear actuators. The bridge includes a first boxed section having a first arm, a second arm and a first base joining the first and second arms. The first arm includes a first bearing section disposed adjacent a first one of the linear actuators and a first mounting point disposed adjacent the first bearing section for securing the first boxed section to a first one of the adjusting rods. The second arm includes a first support point disposed in substantial alignment with and separated a first distance away from the first mounting point for supporting the first one of the adjusting rods. The bridge also includes a second boxed section having a third arm, a fourth arm and a second base joining the third and fourth arms. The third arm includes a second bearing section disposed adjacent a second one of the linear actuators and a second mounting point disposed adjacent the second bearing section for securing the second boxed section to a second one of the adjusting rods. The fourth arm includes a second support point disposed in substantial alignment with and separated a second distance away from the second mounting point for supporting the second one of the adjusting rods. The bridge is also provided with a spine joining the first boxed section and the second boxed section.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
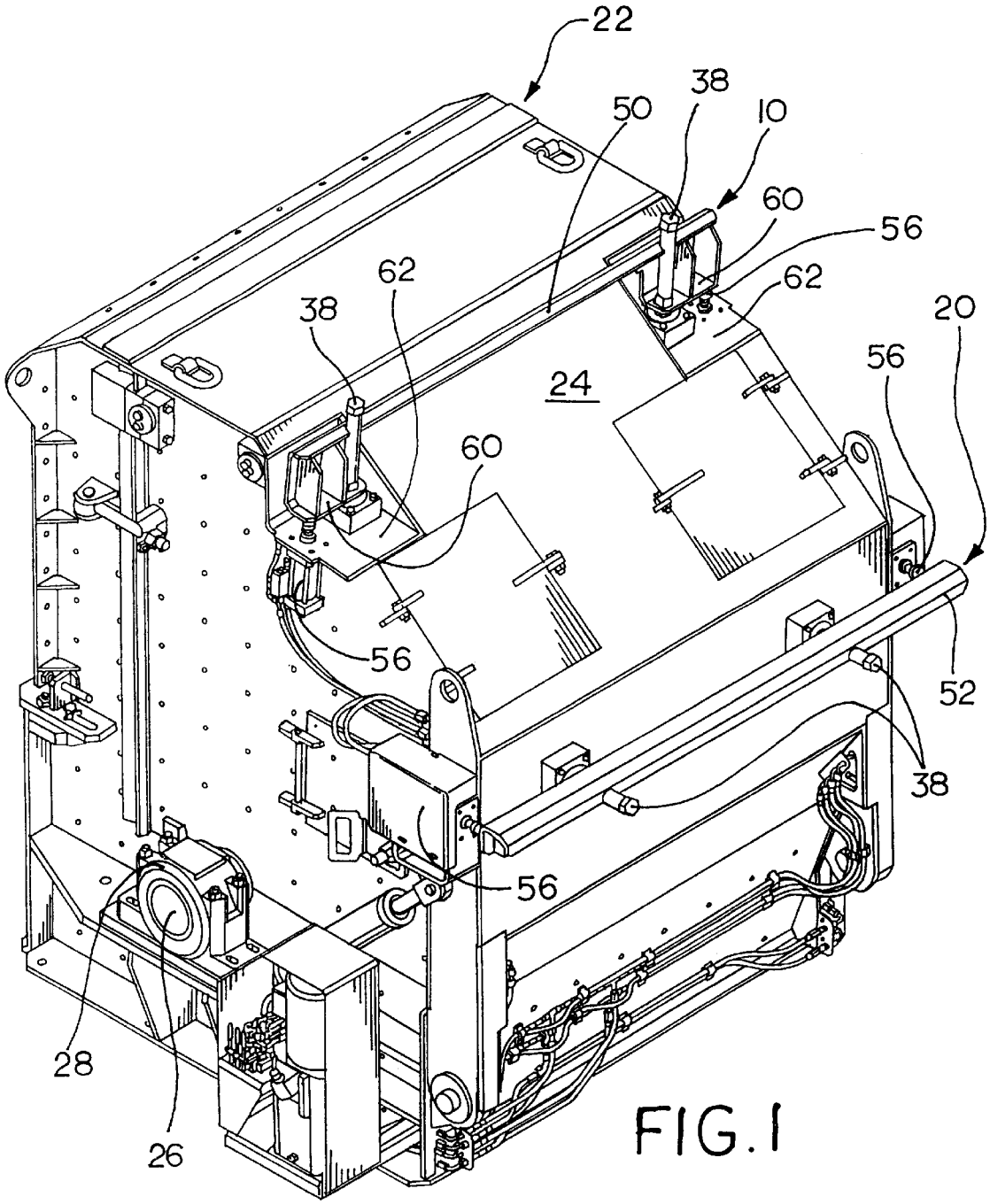
FIG. 1 is a perspective view of a crusher employing bridges constructed in accordance with the teachings of the instant invention.

Apparatus 10, 20 constructed in accordance with the teachings of the invention are shown in FIG. 1 in a preferred environment of use, namely, mounted on a horizontal shaft impact crusher 22. While for clarity of illustration, the apparatus 10, 20 are shown herein mounted on a specific type of crusher 22, persons of ordinary skill in the art will readily appreciate that the teachings of the invention are in no way limited to use with that crusher 22 or to any other particular environment of use. On the contrary, apparatus constructed in accordance with the teachings of the invention may be used with any crusher which would benefit from the advantages they offer without departing from the scope or spirit of the invention.

The illustrated crusher 22 is a horizontal shaft impact crusher. Thus, as is well known in the art, the crusher 22 includes a frame or housing 24 that defines an internal cavity (not shown). An impeller shaft 26 is shown journalled in a bearing 28 mounted adjacent an opening 30 in the frame 24 in FIGS. 1 and 4. The impeller shaft 26 is connected to an impeller assembly (not shown) having a plurality of bars or hammers extending radially from the impeller shaft 26 (not shown) and disposed within the chamber of the crusher 22 for striking and propelling aggregate material. The impeller assembly and the hammers are of the type commonly employed in the art. The impeller shaft 26 is mounted for rotation and extends across the cavity in a generally horizontal position and is coupled to a drive mechanism (not shown) through a drive system, such as a V-belt drive system of the type commonly employed in the art, which imparts rotational movement to the impeller shaft 26 via a drive wheel 32 (see FIG. 3). Material to be crushed is inserted into the cavity through an insertion opening (not shown) defined in the frame 24.

In order to provide a striking surface to break material propelled by the impeller 26 within the cavity, the crusher 22 is further provided with conventional breaker plates (not shown). As is conventional, the illustrated crusher 22 has a primary breaker plate and a secondary breaker plate, both of which are suspended within the cavity adjacent the motion path of the impeller hammers. When material is inserted into the crusher 22, the impeller strikes and propels the material against the breaker plates.

The breaker plates are suspended within the cavity by adjusting rods 38. To this end, the frame 24 is provided with a number of adjusting rod bores 40 (see FIG. 4). The adjusting rods 38 extend through the bores 40 and are secured to the breaker plates within the cavity. As shown in FIG. 1, the rods 38 extend out of the crusher 22. By adjusting the position of the adjusting rods 38, one can adjust the position of the breaker plates within the cavity. To this end, as most easily seen in FIG. 3, each of the adjusting rods 38 is provided with two locking support nuts 39, 41. Each adjusting rod may also be provided with an end cap 43, which may be threaded onto or welded onto the end of the adjusting 38. The operation of the support nuts 39, 41 is explained in further detail below.

For the purpose of selectively relieving the load on the adjusting rods 38, the apparatus 10, 20 are respectively provided with a primary bridge 50 and a secondary bridge 52. As shown in FIG. 1, the primary bridge 50 is mounted to the two adjusting rods 38 that support the primary breaker plate and the secondary bridge 52 is coupled to the two adjusting rods 38 that support the secondary breaker plate within the cavity of the crusher 22. Preferably, the bridges 50, 52 do not add to the height or width of the crusher 22.

Figure 2:
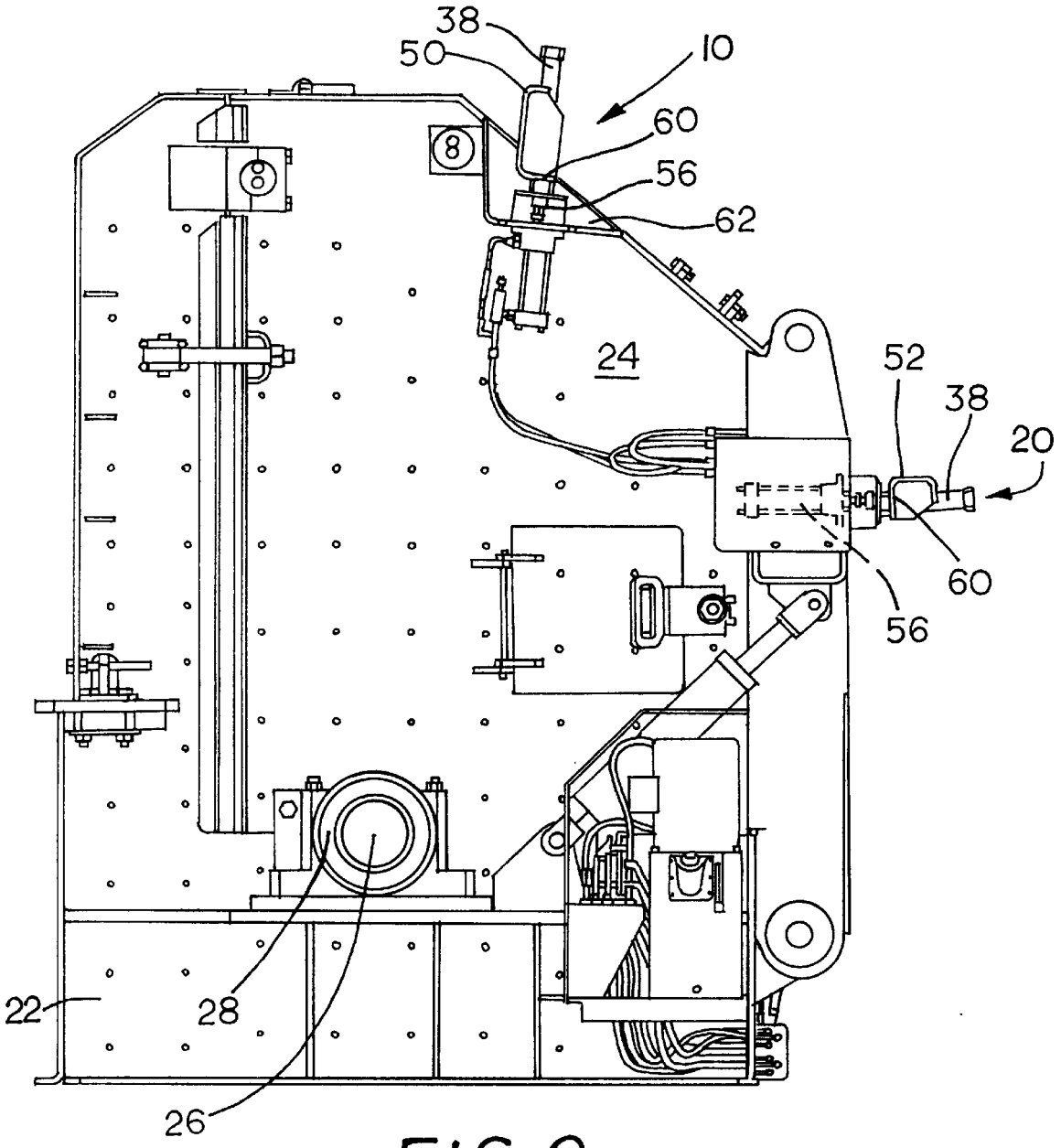
FIG. 2 is a left-side elevational view of the crusher and bridges of FIG. 1.
Figure 3:
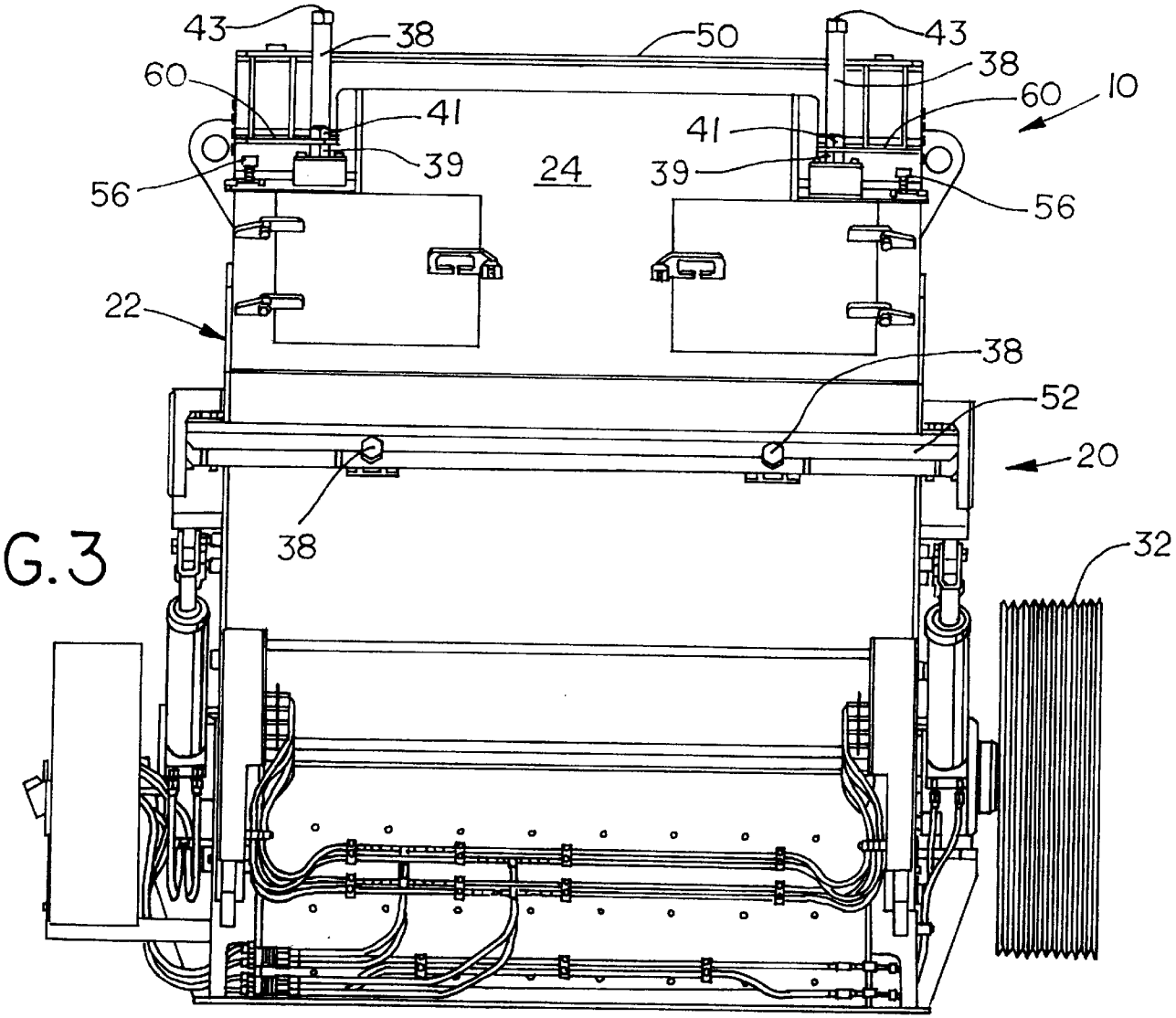
FIG. 3 is a front elevational view of the crusher and bridges of FIG.

To apply a force to the bridges 50, 52 sufficient to at least partially relieve the loads on the adjusting rods 38 to thereby facilitate adjustment of the rods 38, the apparatus 10, 20 are further provided with linear actuators 56. The linear actuators 56, (which are preferably implemented by conventional hydraulic cylinders sized to the weight of the breaker plates, adjusting rods 38 and bridge 50 or 52 they are intended to support), are linearly extendable from a retracted position to an extended position. As shown in FIGS. 1–3, the bridges 50, 52 are each provided with two bearing sections 60 and each apparatus 10, 20 is preferably provided with two linear actuators 56 each of which is disposed to contact a corresponding one of the bearing sections 60 as it moves from the retracted to the extended position. Energizing the linear actuator 56 will, therefore, move the corresponding bridge 50, 52 away from the crusher frame 24 to thereby transfer at least some of the load(s) on the adjusting rods 38 to the linear actuator 56.

Figure 4:
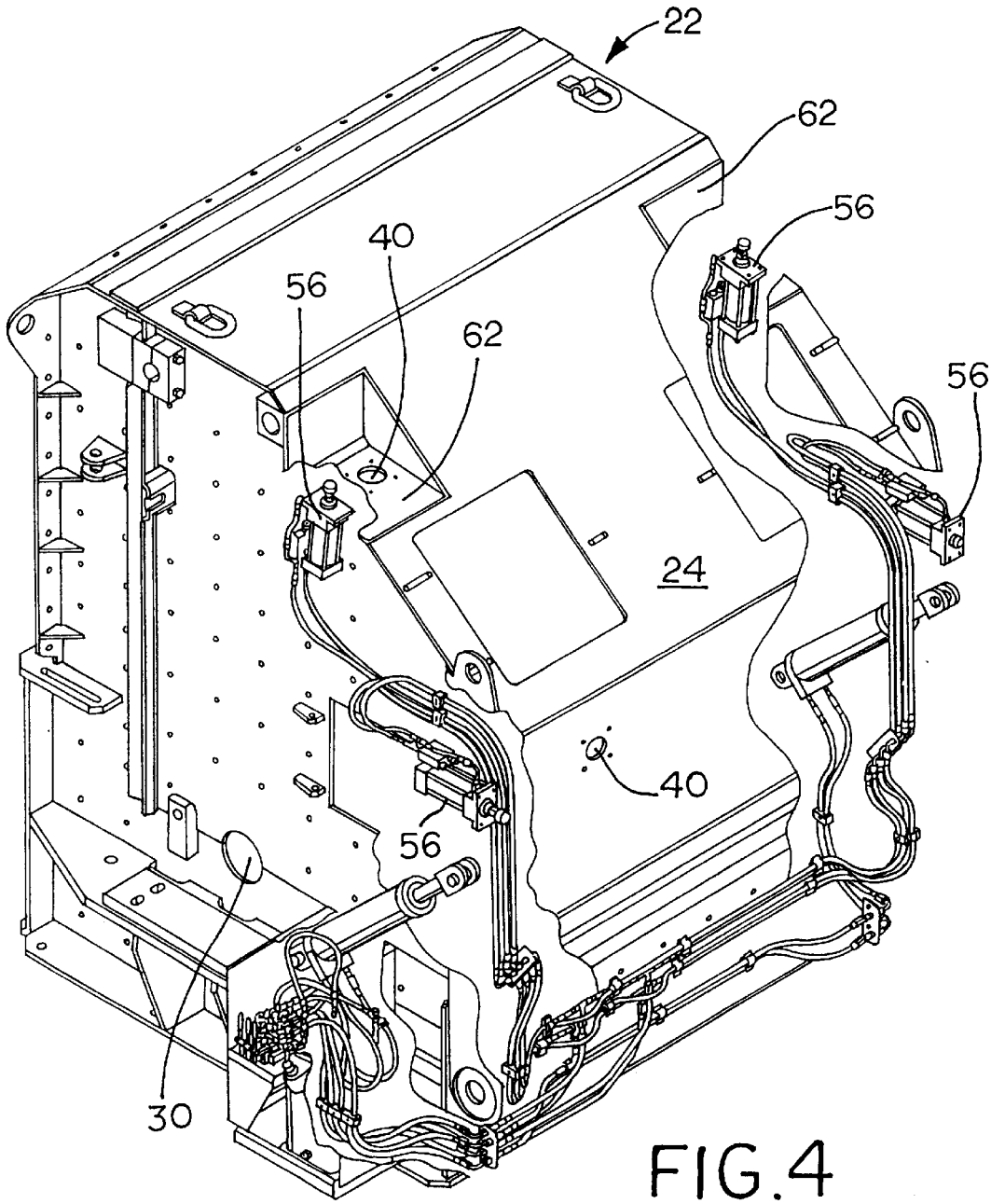
FIG. 4 is a cut-away perspective view of the crusher of FIG. 1 with the bridges and adjusting rods removed.

As shown in FIGS. 1, 2 and 4, the frame 24 of the crusher 22 is preferably provided with cut outs or depressions 62. The cut outs 62 define pockets in which the adjusting rods 38 supporting the primary breaker plate are mounted. Locating the primary adjusting rods 38 in the cut outs 62 serves to reduce the amount the rods 38 extend above the frame 24, thereby effectively reducing the height of the crusher 22.

Providing each bridge 50, 52 with two linear actuators 56, one at each end, enhances the stability of the apparatus 10, 20. Operating the paired actuators 56 in substantial synchronization is preferred to prevent binding and to ensure even load distribution.

Figures 5, 6, 7, 8:
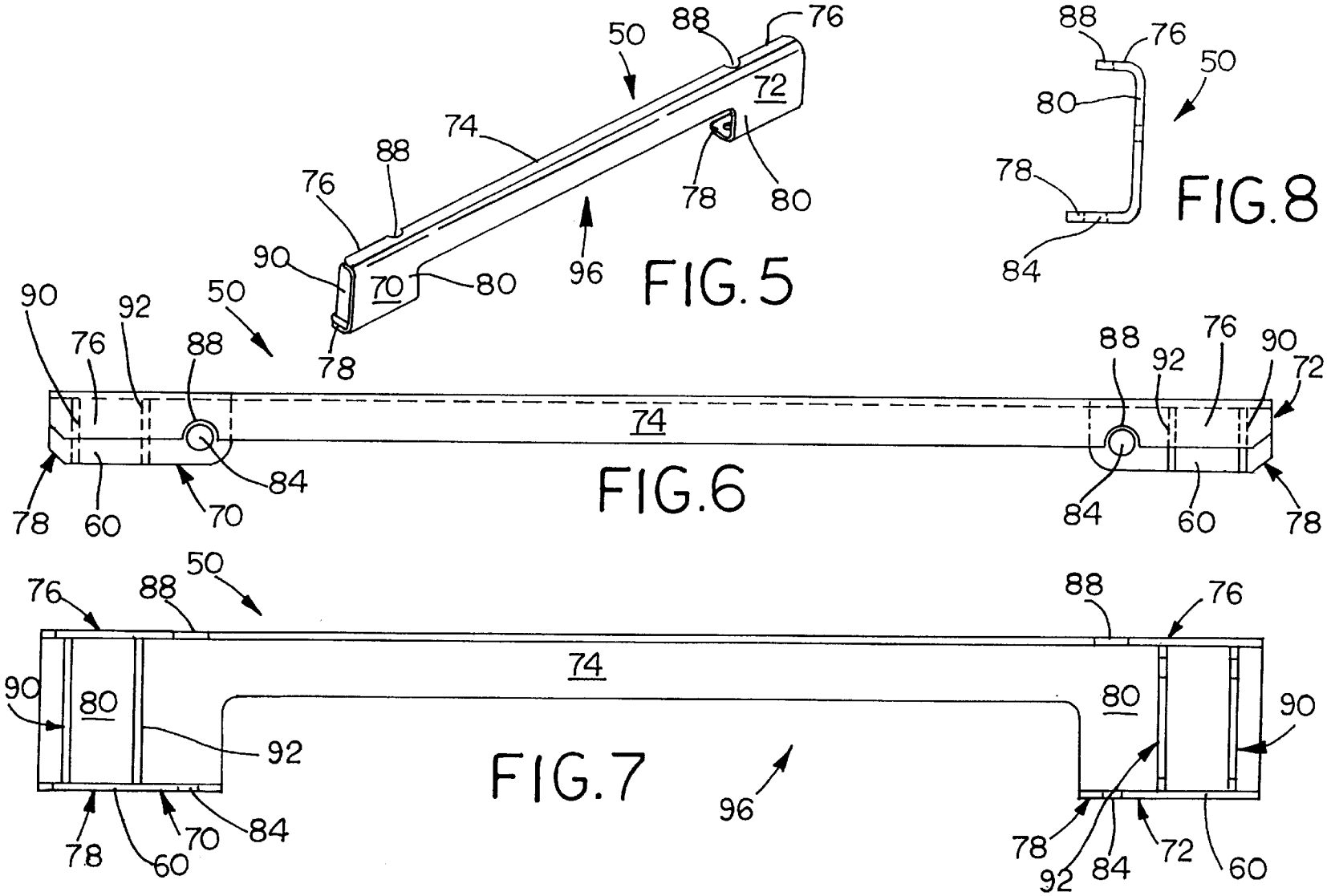
FIG. 5 is a perspective view of the primary bridge of FIG. 1.
FIG. 6 is a top view of the bridge of FIG. 5.
FIG. 7 is a rear elevational view of the bridge of FIG. 5.
FIG. 8 is a side elevational view of the bridge of FIG. 5.

Turning to the structure of the primary bridge 50 in more detail, the bridge 50 is preferably provided with a first boxed section 70, a second boxed section 72 and a spine 74 joining the first and second boxed sections 70, 72 (FIGS. 5–7). As shown in FIGS. 6–7, the boxed sections 70, 72 are preferably substantially identical and arranged as mirror images of one another. Each boxed section 70, 72 has a generally C-shaped or U-shaped cross-section (see FIG. 8) defined by an upper flange or arm 76, a lower flange or arm 78, and a web or base 80 joining the upper and lower arms 76, 78.

The lower arm 78 includes the bearing section 60 mentioned above. It also includes a bore 84 sized to slidably receive one of the adjusting rods 38. The support nuts 39, 41 are preferably too large to pass through the bore 84. As shown in FIG. 3, a first support nut 39 is threadably disposed on the rod 38 beneath the lower arm 78 of the bridge 50. The second support nut 41 is threadably disposed on the rod 38 above the lower arm 78 but beneath the upper arm 76. The end cap 43 is located at the top of the rod 38 above the upper arm 76. The first nut 39 forms a stop limiting the distance the adjusting rod 38 can move into the cavity. Thus, when the actuators 56 are in their retracted positions, the weight of the corresponding breaker plate is carried by the adjusting rods 38 and the first nuts 39.

By extending the actuators 56, the bridge 50 will apply an upward directed force against the second nuts 41. Since the second nuts 41 are also mounted to the adjusting rods 38, this upward movement of the bridge 50 will move the rods 38 upwards thereby transferring the weight of the breaker plate from the first nuts 39 to the second nuts 41. As a result of this weight transference, the position of the first nuts 39 can be adjusted without interference from the weight of the plates such that, when the bridge 50 is lowered and the weight of the breaker plate is again returned to the first nuts 39, the rods 38 will extend a different distance into the cavity to support the breaker plate in a different position. Specifically, if the first nuts 39 are moved upward relating to the rods 38, the rods will ultimately extend further into the cavity. If the first nuts 39 are moved downward relative to the rods 38, the rods will ultimately extend a shorter distance into the cavity. Of course, when the weight of the plate is born by the first nuts 39, the position of the second nuts 41 can be easily adjusted to permit subsequent upward adjustment of the first nuts 39 to lower the rods 38 further into the cavity.

Returning to FIGS. 5–8, because the second nut 41 abuts against the area above and adjacent the bore 84 when the actuators 56 are extended, the area of the lower arm 78 adjacent the bore 84 forms a mounting point for securing the corresponding boxed section 70, 72 to one of the adjusting rods 38.

To increase the stability of the bridge 50, the upper arm 76 of each boxed section 70, 72 defines a recess 88. Each recess 88 is preferably disposed in substantial alignment with a corresponding bore 84. Each of the recesses 88 is dimensioned to slidably receive at least a portion of a corresponding one of the adjusting rods 38. In the illustrated embodiment, the recesses 88 are sized to receive approximately one-half of a transverse section of an adjusting rod 38. As shown in FIGS. 1 and 2, each adjusting rod 38 of the primary breaker plate, thus, simultaneously extends through a bore 84 and recess 88 of a respective one of the boxed sections 70, 72. When the adjusting rods 38 are so disposed, they contact the areas of the upper arm 76 immediately adjacent the recesses 88. These areas of the upper arm 76, thus, act as support points which enhance the stability of the primary bridge 50 during the adjustment procedure. As shown in FIGS. 7 and 8, the support points of the boxed sections 70, 72 are located like distances away from their corresponding mounting points. Preferably, the adjusting rods 38 are located so their range of angular motion through the adjustment range is minimized.

To increase the rigidity of the boxed sections 70, 72, each boxed section 70, 72 is further provided with a pair of supports 90, 92. As most easily seen in FIGS. 6 and 7, the supports 90, 92 are preferably implemented as plates disposed in parallel planes which are each perpendicular to the upper arm 76, the lower 78, and the base 80. One of the supports 92 is located between the bearing section 60 and the mounting point. The other support 90 is located adjacent an end of the bridge 50 on a side of the bearing section 60 opposite the other support 92.

As mentioned above, the linear actuators 56 are each positioned to contact a bearing surface of the bearing section 60 of the boxed sections 70, 72 of the bridge 50. To increase the stability of the bridge 50, the linear actuators 56 are preferably disposed parallel to, and out of alignment with, the adjusting rods 38. In other words, the bearing sections 60 are disposed adjacent the mounting points (i.e., not in vertical alignment with the mounting points). This geometry provides the bridge 50 with enhanced stability.

Significantly, the spine 74 of the primary bridge 50 has a much smaller height than the boxed sections 70, 72. More specifically, as shown in FIGS. 5 and 7, when viewed from the front, the bridge 50 has a contoured profile wherein a recess 96 is formed adjacent and below the spine 74 between the lower portions of the boxed section 70, 72. As shown in FIGS. 1 and 3, the length of the spine 74, and, thus, the length of the recess 96, is such that, when used with the crusher 22 of FIG. 1, the boxed sections 72 simultaneously extend downwardly into respective ones of the cut-outs 62 while the recess 96 of the bridge 50 receives a portion of the frame 24. This geometry ensures the bridge 50 does not add to the overall height of the crusher 22.

The structure of the secondary bridge 52 is illustrated in greater detail in FIGS. 9–12. Since the secondary bridge 52 has much of the same structure as the primary bridge 50, like structures will be referred to herein with like reference numerals preceded by a "1". For example, the boxed sections of the primary bridge 50 were referred to above using reference numerals 70 and 72. Thus, the boxed sections of the secondary bridge 52 shall be referred to with reference numerals 170 and 172.

Figure 9:
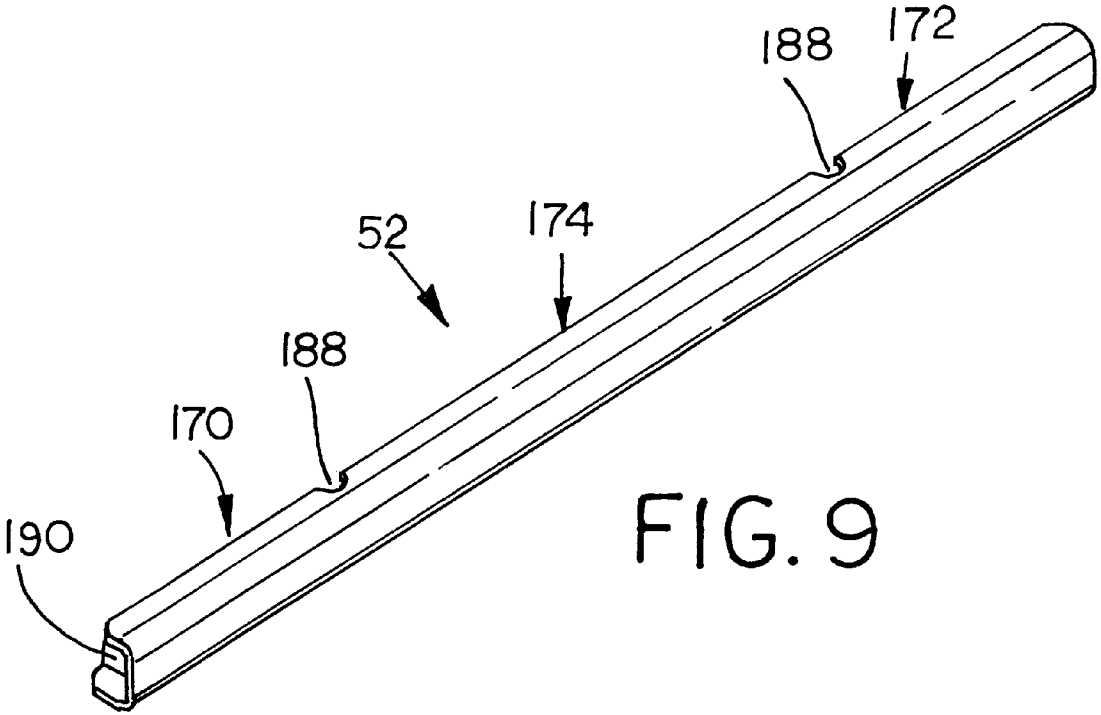
FIG. 9 is a perspective view of the secondary bridge of FIG. 1.
Figure 10:
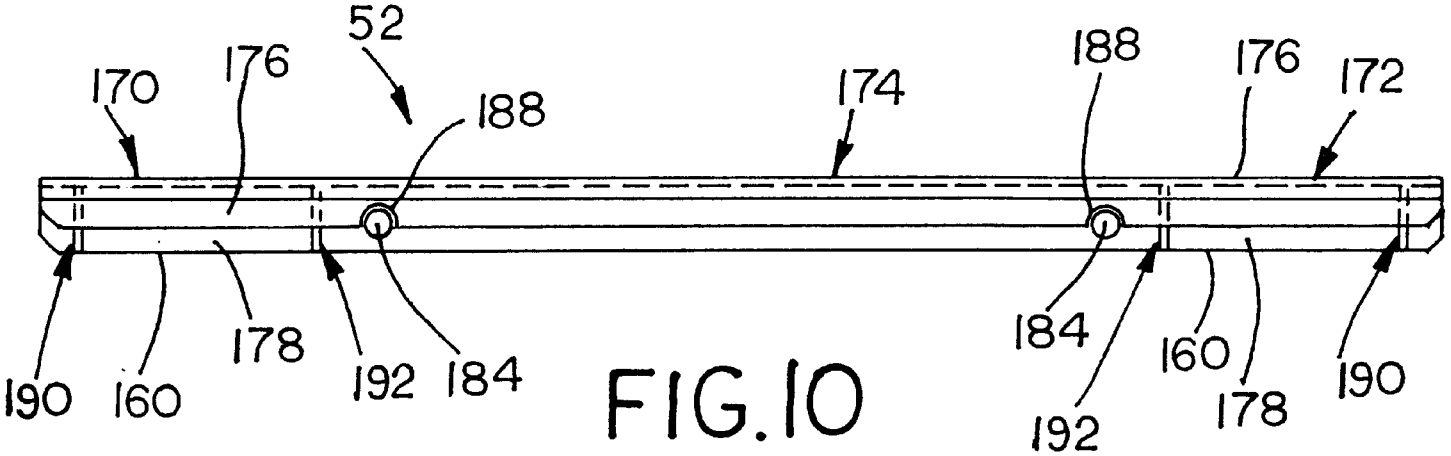
FIG. 10 is a top view of the bridge of FIG. 9.
Figure 11:
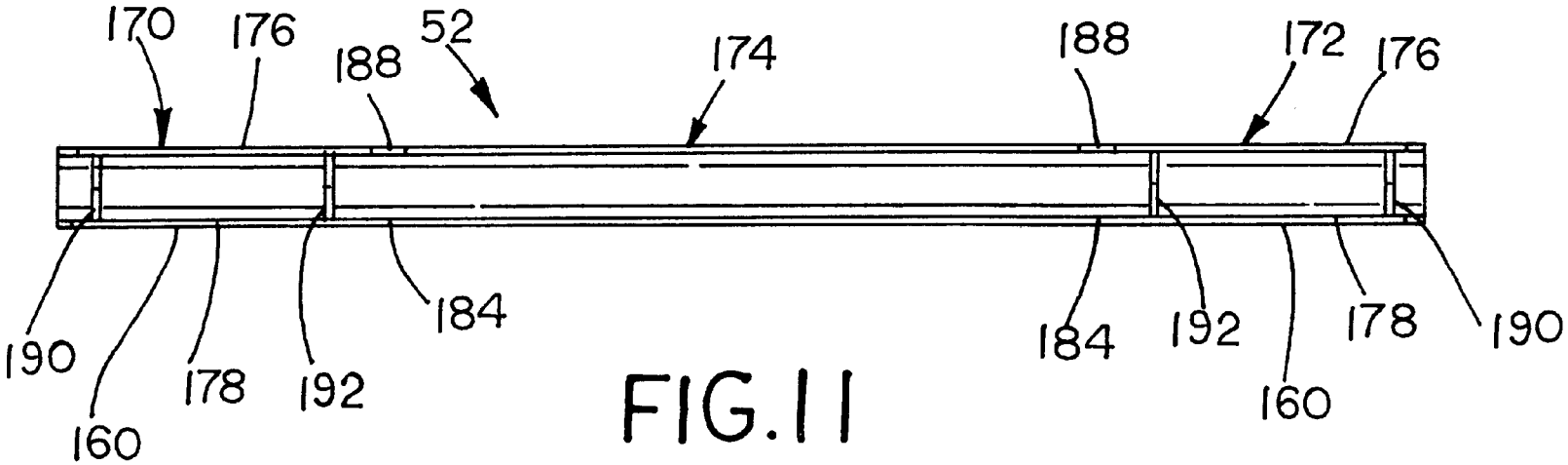
FIG. 11 is a rear elevational view of the bridge of FIG. 9.

Turning to FIGS. 9–10, the secondary bridge 52, like the primary bridge 50, includes two boxed sections 170, 172 and a spine 174. However, unlike the primary bridge 50, the boxed sections 170, 172 and spine 174 of the secondary bridge 52 preferably have the same height.

Figure 12:
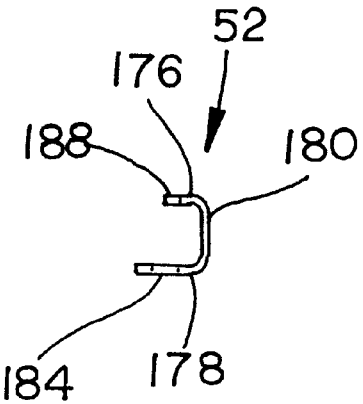
FIG. 12 is a side elevational view of the bridge of FIG. 9.

As with the primary bridge 50, the boxed sections 170, 172 of the secondary bridge 52 have a substantially U-shaped cross-section formed by an upper arm 176, a lower arm 178 and a base 180 (see FIG. 12). However, since the spine 174 has the same height as the boxed sections 170, 172, in the secondary bridge 52, the upper arms 176, the lower arms 178, and the base 180 extend the entire length of the bridge in one, unitary structure having a U-shaped cross-section.

As with the primary bridge 50, the boxed sections 170, 172 of the secondary bridge 52 include bores 184 for receiving adjusting rods 38, recesses 188 in substantial alignment with the bores 184, and supports 190, 192 which function like the similarly numbered portions of the primary bridge 50. The boxed sections 170, 172 also include bearing sections 160, mounting points and support points which function substantially identically to the like numbered parts of the primary bridge 50. In view of the close similarities between these parts, in the interest of brevity, the description of these parts will not be repeated here. Instead, the interested reader is referred to the above description of the primary bridge 50 for a complete discussion of these parts.

One difference between the primary bridge 50 and the secondary bridge 52 bears further mention here. In particular, the bores 184, recesses 188, mounting points and support points of the secondary bridge 52 are located closer to the center of the bridge 52 than the like structures in the primary bridge 50. As a result, the boxed sections 170, 172 of the secondary bridge 52 are longer than the boxed sections 70, 72 of the primary bridge 50, and the spine 174 of the secondary bridge 52 is shorter than the spine 74 of the primary bridge 50. This difference in geometry accommodates the size difference of the primary and secondary breaker plates while still permitting the mounting of the hydraulic cylinders adjacent the sides of the frame 24.

Persons of ordinary skill in the art will readily appreciate that bridges constructed in accordance with the teachings of the invention can be retrofit on many different crushers and breaker plates without departing from scope or spirit of the invention.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use with a horizontal shaft impact crusher having a frame defining a cavity, a breaker plate and a pair of adjusting rods supporting the breaker plate within the cavity, the adjusting rods extending out of the cavity, an apparatus for selectively relieving the load on the adjusting rods comprising:

a first linear actuator mounted to the frame outside of the cavity, the first linear actuator having a first position and a second position; and a bridge having a first bearing section disposed adjacent the first linear actuator, the bridge being secured to each of the adjusting rods such that, as the first linear actuator moves from the first position to the second position, the first linear actuator applies a force to the first bearing section to thereby at least partially relieve the load on the adjusting rods, the bridge being sized such that, when the first linear actuator is in the first position, the bridge does not add to the height of the crusher.

2. An apparatus as defined in claim 1 wherein the first linear actuator is disposed on a first side of the frame, wherein the bridge includes a second bearing section, and wherein the apparatus further comprises a second linear actuator disposed on a second side of the frame opposite the first side, the second linear actuator having a first position and a second position and being positioned to apply a force to the second bearing section as the second linear actuator moves from the first position to the second position.

3. An apparatus as defined in claim 2 wherein the first and second linear actuators are actuated between their first and second positions in substantial synchronization.

4. An apparatus as defined in claim 1 wherein the first bearing section has a first bearing surface located for contacting the first linear actuator.

5. An apparatus as defined in claim 1 wherein the portions of the bridge secured to the adjusting rods have U-shaped cross-sections comprising a first arm, a second arm and a base joining the first and second arms.

6. An apparatus as defined in claim 5 wherein each of the adjusting rods is mounted to a respective one of the first arms at a mounting point and is disposed against a respective one of the second arms at a support point.

7. An apparatus as defined in claim 6 wherein each of the second arms defines a recess dimensioned to receive at least a portion of an adjusting rod at the support point.

8. An apparatus as defined in claim 6 wherein the first bearing section is positioned out of alignment with the mounting points.

9. An apparatus as defined in claim 6 wherein the first linear actuator is disposed substantially parallel to and adjacent one of the adjusting rods.

10. An apparatus as defined in claim 5 further comprising a support plate disposed between the first and second arms in proximity to the first bearing section.

11. An apparatus as defined in claim 1 wherein the bridge comprises a first end having a first height, a second end disposed opposite the first end and having a second height, and a spine joining the first and second ends, the spine having a third height which is smaller than the first and second heights.

12. For use with a horizontal shaft impact crusher having a frame defining a cavity, a breaker plate, a pair of adjusting rods supporting the breaker plate within the cavity and extending out of the cavity, and a pair of linear actuators, a bridge comprising:

a first boxed section having a first arm, a second arm and a first base joining the first and second arms, the first arm including a first bearing section disposed adjacent a first one of the linear actuators and a first mounting point disposed adjacent the first bearing section for securing the first boxed section to a first one of the adjusting rods, the second arm including a first support point disposed in substantial alignment with and separated a first distance away from the first mounting point for supporting the first one of the adjusting rods;

a second boxed section having a third arm, a fourth arm and a second base joining the third and fourth arms, the third arm including a second bearing section disposed adjacent a second one of the linear actuators and a second mounting point disposed adjacent the second bearing section for securing the second boxed section to a second one of the adjusting rods, the fourth arm including a second support point disposed in substantial alignment with and separated a second distance away from the second mounting point for supporting the second one of the adjusting rods; and a spine joining the first boxed section and the second boxed section.

13. The bridge as defined in claim 12 wherein the first and second distances are substantially the same.

14. The bridge as defined in claim 12 wherein the second arm defines a recess for at least partially receiving the first adjusting rod and the third arm defines a recess for at least partially receiving the second adjusting rod.

15. The bridge as defined in claim 12 wherein the first boxed section further comprises a first support disposed between the first and second arms.

16. The bridge as defined in claim 15 wherein the first support is disposed in a plane substantially perpendicular to the first base, to the first arm and to the second arm.

17. The bridge as defined in claim 16 wherein the first support is disposed between the first bearing section and the first mounting point.

18. The bridge as defined in claim 16 wherein the first boxed section further comprises a second support disposed between the first and second arms in a plane substantially perpendicular to the first base, to the first arm and to the second arm, the first support being disposed on a first side of the first bearing section and the second support being disposed on a second side of the first bearing section, the second side being located opposite the first side.

19. A bridge as defined in claim 18 wherein the second boxed section further comprises a third support disposed between the third and fourth arms, and the third support is disposed in a plane substantially perpendicular to the second base, to the third arm and to the fourth arm.

20. A bridge as defined in claim 19 wherein the second support is disposed between the second bearing section and the second mounting point.

21. A bridge as defined in claim 20 wherein the second boxed section further comprises a fourth support disposed between the third and fourth arms in a plane substantially perpendicular to the second base, to the third arm and to the fourth arm, the third support being disposed on a first side of the second bearing section and the fourth support being disposed on a second side of the second bearing section, the second side being located opposite the first side.

22. A bridge as defined in claim 12 wherein the first boxed section has a first height, the second boxed section has a second height, and the spine has a third height, the third height being smaller than the first and second heights.

* * * * *